US008876478B2

(12) United States Patent
Wassynger et al.

(10) Patent No.: US 8,876,478 B2
(45) Date of Patent: Nov. 4, 2014

(54) TURBINE BLADE COMBINED DAMPER AND SEALING PIN AND RELATED METHOD

(75) Inventors: Stephen Paul Wassynger, Simpsonville, SC (US); Daniel Howard Tragesser, Simpsonville, SC (US); Matthew Durham Collier, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1012 days.

(21) Appl. No.: 12/948,364

(22) Filed: Nov. 17, 2010

(65) Prior Publication Data

US 2012/0121424 A1 May 17, 2012

(51) Int. Cl.

| | |
|---|---|
| ***F01D 5/10*** | (2006.01) |
| ***F01D 5/26*** | (2006.01) |
| ***F01D 25/04*** | (2006.01) |
| ***F01D 5/24*** | (2006.01) |
| ***F01D 11/00*** | (2006.01) |

(52) U.S. Cl.

CPC ..... *F01D 5/24* (2013.01); *F05D 2260/96* (2013.01); *F01D 11/006* (2013.01)

USPC ..... 416/190; 415/119; 416/193 A

(58) Field of Classification Search

CPC ..... F01D 11/006

USPC ..... 415/119; 416/190, 192, 193 A, 500

See application file for complete search history.

(56) References Cited

U.S. PATENT DOCUMENTS

| | | | | |
|---|---|---|---|---|
| 3,266,770 | A * | 8/1966 | Harlow | 416/92 |
| 4,088,421 | A * | 5/1978 | Hoeft | 416/193 A |
| 5,156,528 | A | 10/1992 | Bobo | |
| 5,803,710 | A * | 9/1998 | Dietrich et al. | 416/248 |
| 5,827,047 | A | 10/1998 | Gonsor et al. | |
| 6,354,803 | B1 * | 3/2002 | Grover et al. | 416/190 |
| 6,390,775 | B1 | 5/2002 | Paz | |
| 6,450,769 | B2 | 9/2002 | Szwedowicz | |
| 6,776,583 | B1 | 8/2004 | Wang et al. | |
| 6,851,932 | B2 * | 2/2005 | Lagrange et al. | 416/190 |
| 6,932,575 | B2 * | 8/2005 | Surace et al. | 416/193 A |
| 7,121,802 | B2 * | 10/2006 | Athans et al. | 416/193 A |
| 7,163,376 | B2 | 1/2007 | Itzel et al. | |
| 7,238,002 | B2 | 7/2007 | Cairo et al. | |
| 7,367,123 | B2 * | 5/2008 | Itzel et al. | 29/889.2 |
| 7,534,090 | B2 * | 5/2009 | Good et al. | 416/193 A |
| 7,575,416 | B2 | 8/2009 | Funk et al. | |
| 7,628,588 | B2 | 12/2009 | Itzel et al. | |
| 2006/0056974 | A1 | 3/2006 | Beattie | |

FOREIGN PATENT DOCUMENTS

| | | |
|---|---|---|
| EP | 2009247 A2 | 12/2008 |

* cited by examiner

*Primary Examiner* — Ned Landrum
*Assistant Examiner* — Ryan Ellis
(74) *Attorney, Agent, or Firm* — Nixon & Vanderhye P.C.

(57) ABSTRACT

A damper pin for a turbine bucket includes an elongated main body portion having a first substantially uniform cross-sectional shape and axially-aligned, leading and trailing end portions having a second relatively smaller cross-sectional shape at opposite ends of the main body portion. A seal element is provided on one or both of the opposite leading and trailing end portions projecting radially outwardly beyond the main body portion.

19 Claims, 8 Drawing Sheets

TURBINE BLADE COMBINED DAMPER AND SEALING PIN AND RELATED METHOD

BACKGROUND OF THE INVENTION

The present invention relates generally to turbo machines and particularly, to damper pins disposed between adjacent buckets on a rotor wheel for damping bucket vibrations.

As is well known, turbines generally include a rotor comprised of a plurality of rotor wheels, each of which mounts a plurality of circumferentially-spaced buckets. The buckets each typically include an airfoil, a platform, a shank and a dovetail, the dovetail being received in mating dovetail slot in the turbine wheel. The airfoils project into a hot gas path downstream of the turbine combustors and convert kinetic energy into rotational, mechanical energy. During engine operation, vibrations are introduced into the turbine buckets and if not dissipated, can cause premature failure of the buckets.

Many different forms of vibration dampers have been proposed to minimize or eliminate vibrations. Vibration dampers are often in the form of an elongated damper pin that fits between adjacent buckets and provides the damping function by absorbing harmonic stimuli energy produced as a result of changing aerodynamic loading. The damper pin is typically retained in a groove formed along one circumferentially-oriented "slash face" in the turbine blade shank region of one of each pair of adjacent buckets. The damping pin is centrifugally loaded during operation and, in order to prevent bucket-to-bucket binding, the groove must be machined so as to allow the pin to float relatively freely within the groove.

At the same time, highly-compressed air is often extracted from the compressor of an axial turbine for the purpose of cooling turbine components. This cooling air is required to maintain the temperature of the turbine components at an acceptable level for operation, but comes at a cost to overall turbine efficiency and output. Any of the cooling flow that leaks out of the turbine components is essentially wasted. The pocket created by a damper pin groove provides a large leakage path for cooling flow to escape from the bucket shank region. The cooling efficiency can also be impaired by ingress of hot gas from the hot gas path into the bucket shank region.

It would therefore be desirable to add a sealing feature to otherwise conventional damper pins in order to prevent, minimize or control the escape of cooling flow from a pressurized shank cavity, prevent or minimize flow from leaking across the turbine blade from the forward wheel space to the aft wheel space in the case of a non-pressurized shank cavity, and/or to prevent ingress of hot gas path air into the shank region.

BRIEF SUMMARY OF THE INVENTION

In accordance with a first exemplary but non-limiting embodiment, the present invention provides a damper pin for a turbine bucket comprising: an elongated main body portion having a first substantially uniform cross-sectional shape and axially-aligned, leading and trailing end portions having a second relatively smaller cross-sectional shape at opposite ends of the main body portion, the leading and trailing end portions joining the elongated main body portion at respective shoulders; and a seal element on one or both of the opposite leading and trailing end portions projecting radially outwardly beyond the main body portion.

In another exemplary but non-limiting embodiment, the present invention provides a turbine rotor wheel comprising a plurality of circumferentially arranged buckets, each adjacent pair of buckets having a damper pin inserted therebetween, the damper pin comprising an elongated main body portion of a first substantially uniform cross-sectional shape, with opposite leading and trailing ends of a different cross-sectional shape, and a seal element on one or both of the opposite leading and trailing end portions projecting radially outwardly beyond the main body portion.

In still another exemplary but non-limiting aspect, the present invention provides in a turbine rotor wheel comprising a plurality of circumferentially arranged buckets, each adjacent pair of buckets having a damper pin inserted therebetween, the damper pin comprising an elongated main body portion of a first substantially uniform cross-sectional shape, with opposite leading and trailing ends of a different cross-sectional shape, a method for controlling escape of cooling air from a cavity in a shank portion of the bucket along the damper pin, the method comprising providing at least one seal element on the damper pin; and providing at least one recess or slot in the shank portion of the bucket; and locating the damper pin such that the at least one seal element is seated in the at least one recess.

The invention will now be described in detail it connection with the drawings identified below.

DETAILED DESCRIPTION OF THE INVENTION

Figure 1:
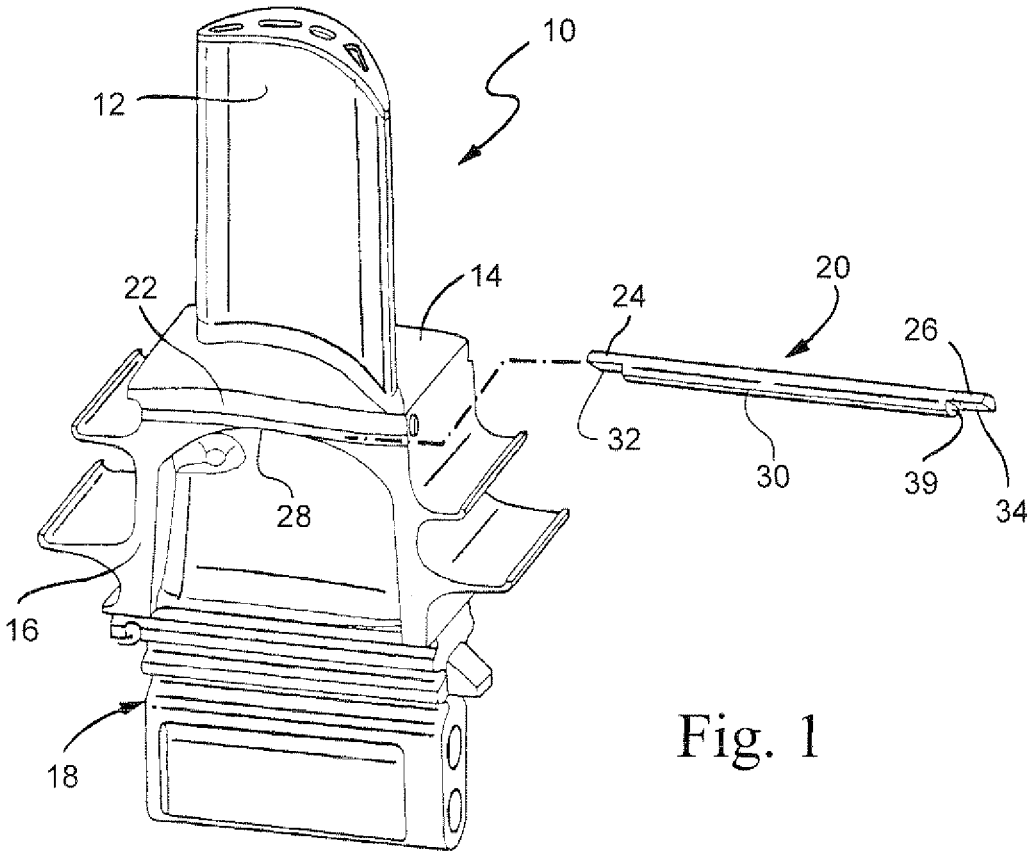
FIG. 1 is a perspective view of a gas turbine bucket and damper pin assembly.

FIG. 1 illustrates a conventional bucket 10 including an airfoil 12, a platform 14, a shank 16 and a dovetail 18. The dovetail 18 is utilized to secure the bucket 10 about the periphery of the rotor wheel (not shown), as is well understood in the art. A damper pin 20 is located along one axial edge (or slash face) 22 adjacent (i.e., radially inward of) the bucket platform 14 with the leading end 24 of the damper pin 20 located nearer the leading edge of the bucket, and the trailing end 26 of the damper pin located nearer the trailing edge of the bucket.

Figure 2:
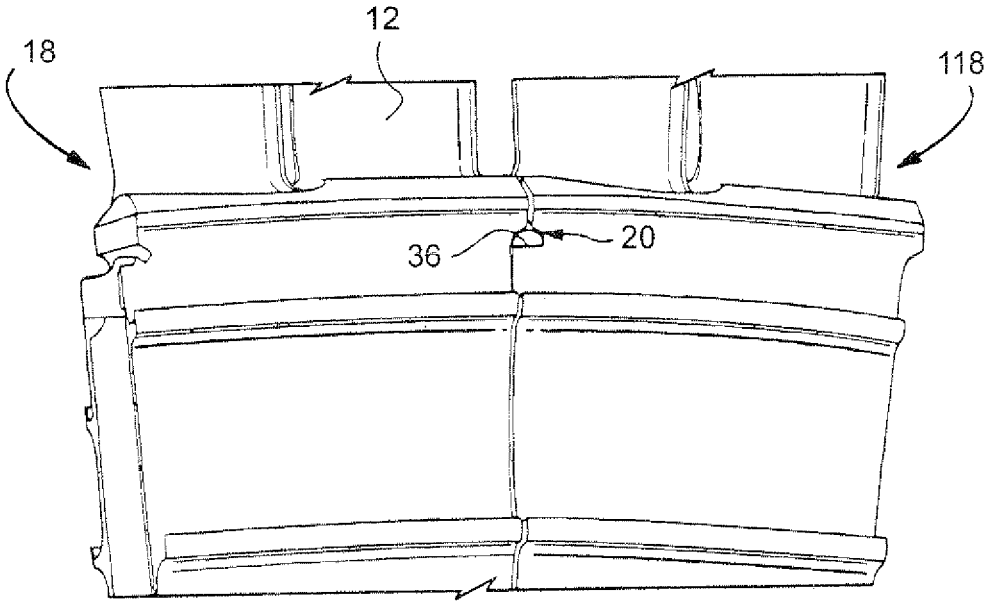
FIG. 2 is a partial side elevation showing a pair of circumferentially adjacent buckets with a damper pin located therebetween.

It will be appreciated that a similar pin 20 is located between each adjacent pair of buckets 18, 118 on the turbine wheel, as apparent from FIG. 2. Specifically, the damper pin 20 is located in a groove 28 extending along the entire slash face 22 of the bucket 118. The damper pin includes a substantially cylindrical body portion 30 between a pair of substantially semi-cylindrical, opposite ends 24, 26 interfacing at shoulders 39. This configuration creates flat support surfaces 32, 34 (best seen in FIG. 1) that are adapted to rest on the machined bucket platform surfaces or shoulders (one shown at 36 in FIG. 2) at opposite ends of the groove 28 formed in the bucket slash face, thereby providing good support for the pin while preventing undesirable excessive rotation during machine operation.

Figure 3:
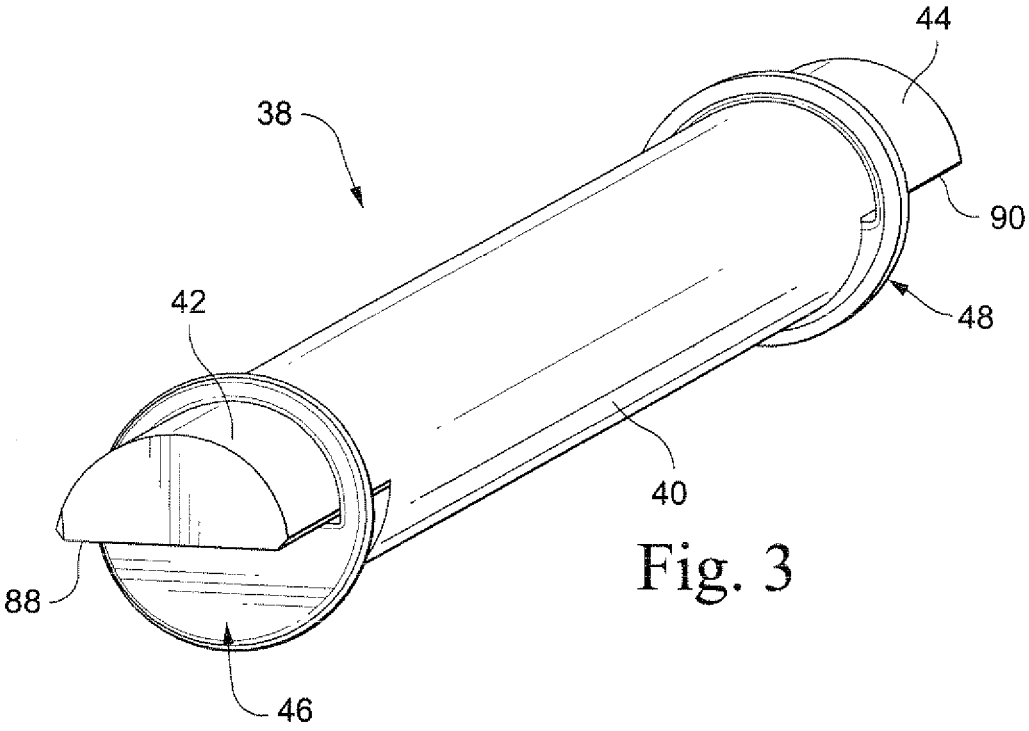
FIG. 3 is a perspective view of a damper pin with attached seal elements in accordance with a first exemplary but non-limiting embodiment of the invention.
Figure 4:
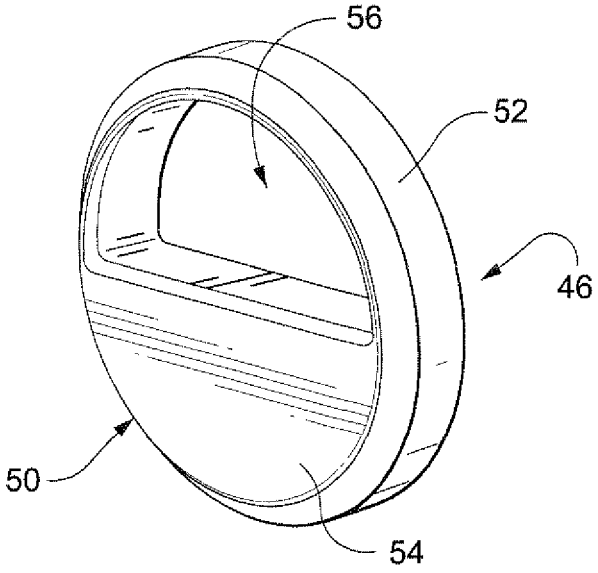
FIG. 4 is a perspective view of one seal element shown in FIG. 3, removed from the damper pin.

With reference now to FIGS. 3 and 4, a damper pin 33 in accordance with a first exemplary but nonlimiting embodiment is illustrated. Like the conventional pin described above, the pin 38 includes a substantially cylindrical body portion 40 and a pair of reduced cross-section, substantially semi-cylindrical, opposite ends 42, 44. The damper pin 38 is now provided with a sealing feature in the form of a pair of attached seal elements 46, 48 provided, respectively, at the interfaces (or shoulders 39) between the cylindrical body portion 40 and the opposite ends 42, 44. Each of the mirror image seal elements is formed as a substantially circular disc 50 having an annular peripheral rim 52. The circular disc 50 includes a solid half-section 54 and an open half section, the latter defined by a substantially semi-circular opening or aperture 56 that allows the seal element to be received over a respective end 42 or 44 of the damper pin 38.

The seal elements 46, 48 may be composed of the same or different alloy material as the damper pin 38. For example, either or both of the damper pin 46 and seal elements 46, 48 may be a Nickel-based alloy such as X-750, or a cobalt-based alloy such as L-605. It will be understood, however, that the invention is not limited by the choice of alloy materials for either the pin 38 or the seal elements 46, 48.

The seal elements 46, 48 are sized to slide somewhat loosely over the ends 42, 44 of the damper pin 42, so that the seal elements can easily seat within mating, machined slots or recesses 58, 60 formed in the bucket shank 62 at the slash face (FIG. 8) as described further below. It is intended that most if not all radial loading during machine operation be taken up by the damper pin 38 as it moves radially within its slash groove 64 (FIG. 8) due to centrifugal forces and as permitted by the loose tolerances. The tolerances relating to the slots or recesses 58, 60 and groove 64 and damper pin/sealing elements 46, 48 also allow for some minimal rotation of the damper pin during machine operation, but centrifugal forces are not taken up by the seal elements themselves.

The damper pin 38 provides the desired damping between adjacent buckets as in prior designs, while the seal elements 42, 44 provide a barrier that prevents, minimizes or controls escape of cooling air from of pressurized cavity in the shank portion along the pin, especially nearer the leading edge of the bucket. In the case of a non-pressurized cavity, the seal elements also prevent, minimize or control leakage across the bucket from the forward wheel space to the aft wheel space. In addition, the seal elements also serve to prevent or minimize any ingress of hot combustion gases into the shank portion along the pin, especially nearer the trailing edge of the bucket.

Figure 5:
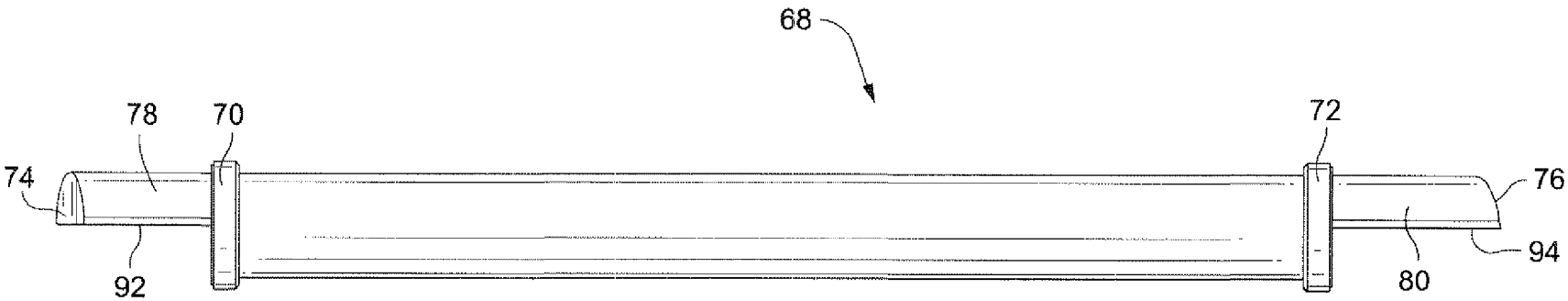
FIG. 5 is a side elevation view of a damper pin similar to that shown in FIG. 3, but wherein the seal element has been made integral with the damper pin.
Figure 6:
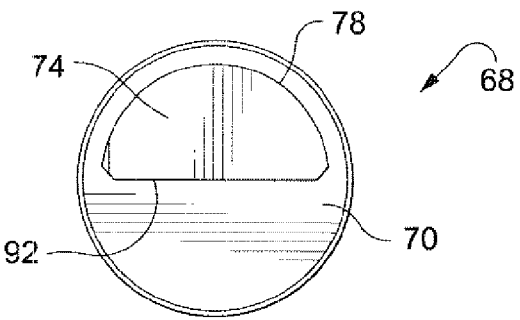
FIG. 6 is an end view of the pin shown in FIG. 5.
Figure 7:
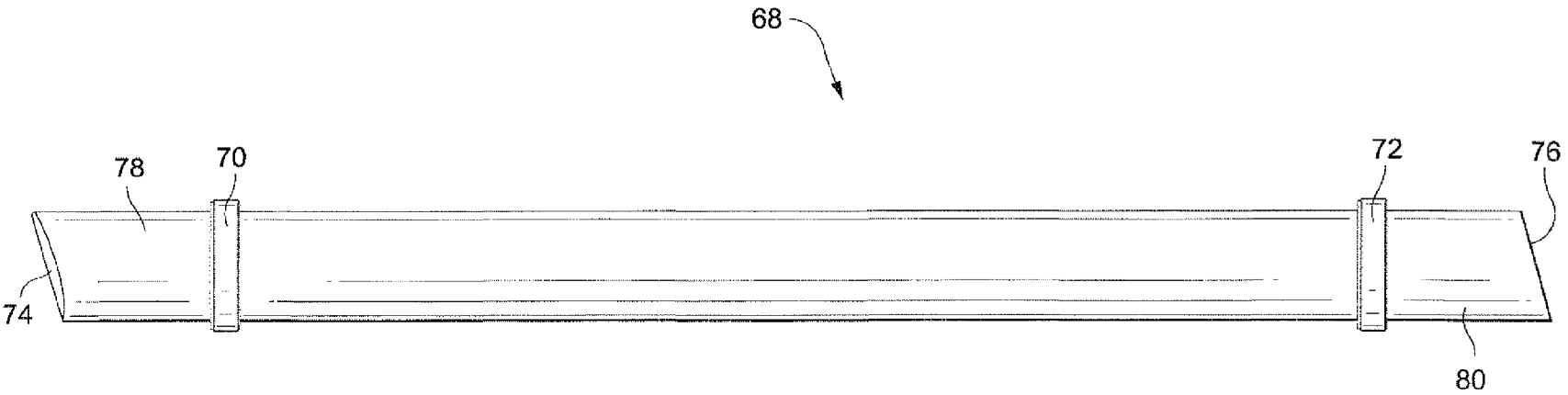
FIG. 7 is a plan view of the pin shown in FIG. 5.

FIGS. 5-7 illustrate a variation of the damper pin 38 shown in FIGS. 3 and 4. Here, the damper pin 68 and seal elements 70, 72 are formed integrally as one piece. The damper pin otherwise is substantially the same as damper pin 38. Here again, the seal elements 70, 72 are seated relatively loosely in the machined slots or recesses 58, 60.

Figure 9:
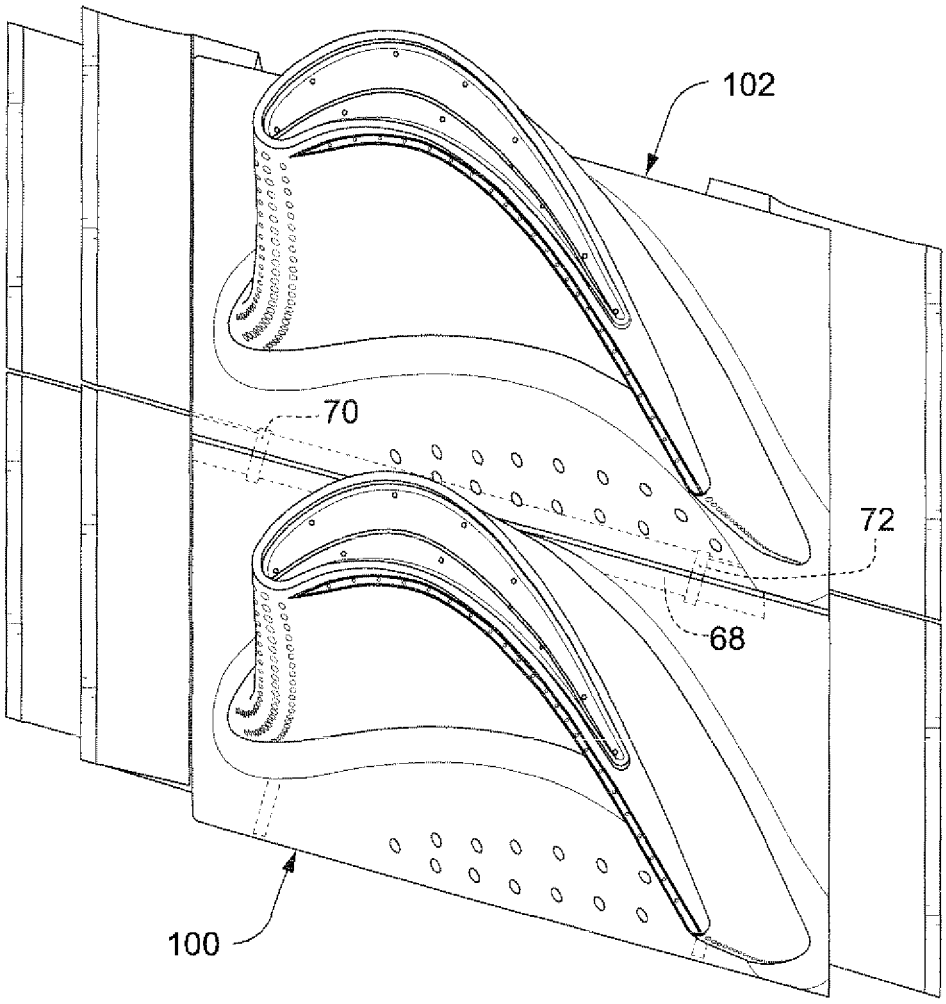
FIG. 9 is a top plan view of the damper pin of FIGS. 4-6 (shown in phantom) installed between two adjacent buckets.

Edge faces 74, 76 of the reduced cross-sectional ends 78, 80 are angled to match the adjacent bucket edges as best seen in FIG. 9.

Figure 8:
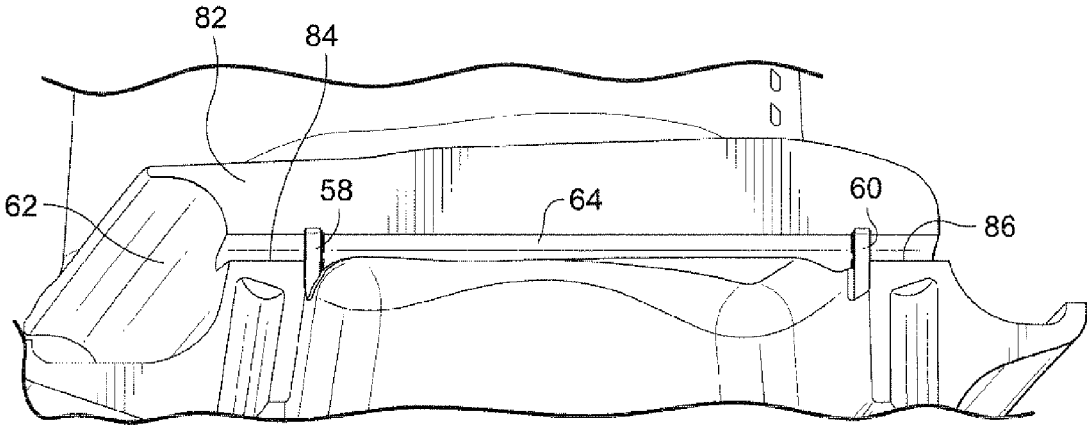
FIG. 8 is a partial perspective view of a bucket shank, illustrating a groove adapted to receive the damper pins of FIG. 3 or 5.

FIG. 8 illustrates the groove 64 formed in the slash face 82 of a bucket. The groove 64 is shaped to include the machined support surfaces 84, 86 adapted to engage the flat surfaces 88, 90 of the semi-circular ends 42, 44 of the damper pin 38, or the flat surfaces 92, 94 of the semi-cylindrical ends 96, 98 of the pin 68.

FIG. 9 illustrates the damper pin 68 seated between two adjacent buckets 100, 102. The damper pin extends substantially parallel to the opposed bucket slash faces, requiring the pin end faces 74, 76 (as mentioned above) to be cut at a non-perpendicular angle relative to a longitudinal axis of the damper pin to remain flush with the end faces of the buckets.

Figure 10:
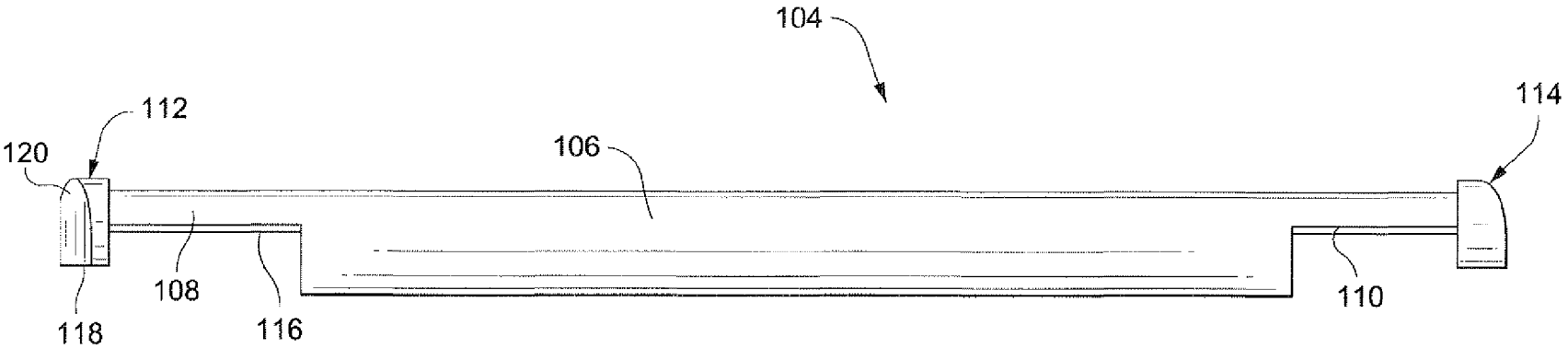
FIG. 10 is a side elevation of an alternative damper pin incorporating seal elements in accordance with another exemplary but non-limiting embodiment of the invention.
Figure 11:
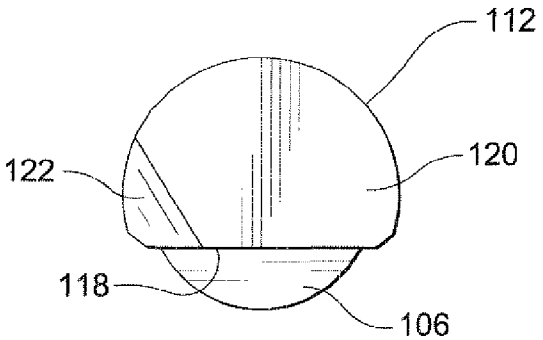
FIG. 11 is an end view of the damper pin shown in FIG. 10.
Figure 12:
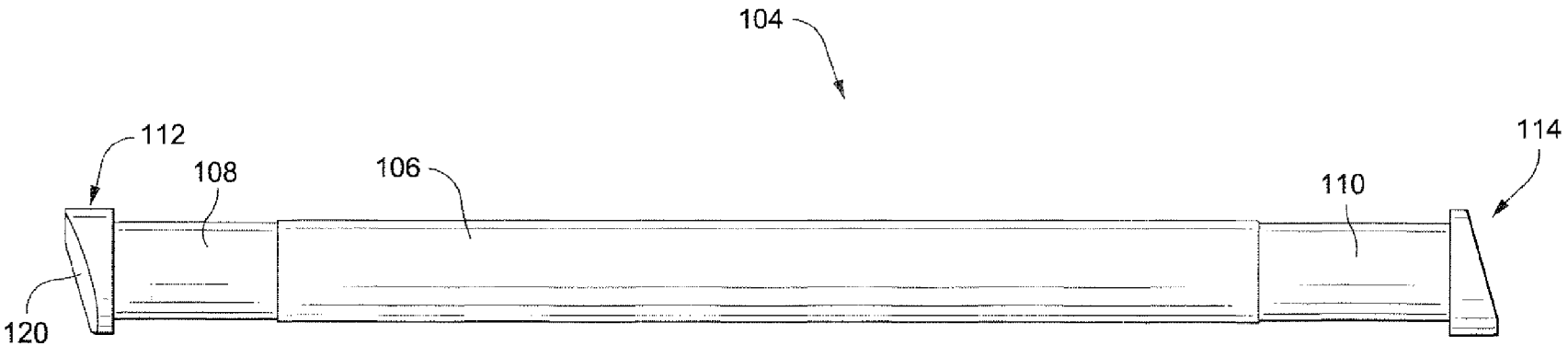
FIG. 12 is a top plan view of the pin shown in FIG. 10.

FIGS. 10-12 illustrate another exemplary but nonlimiting embodiment of a damper pin provided with a sealing feature. The damper pin 104 is formed to include a cylindrical body portion 106 and opposite ends opposite ends 108, 110 of substantially semi-circular cross-section as in the previous embodiments. In this embodiment, however, the integral seal elements 112, 114 are formed at the outer tips of the opposite ends 108, 110. Because the seal elements are identical, only one need be described. The seal element 112 extends radially beyond the arcuate segment of the semi-circular end 108 of the pin in all directions, including beyond the flat support surface 116, creating a flat 118 that extends substantially parallel to the support surface 116. Thus, the arcuate extent of the seal element is greater than 180°, as best seen in FIGS. 30 and 11. Note that as in the previously described embodiments, edge surface 120 of the seal is machined at an angle to the longitudinal axis of the damper pin 104 so that the seal edge surface will remain flush with adjacent bucket surfaces when installed, similar to the end edges 74, 76 of the damper pin 68 described above. A further beveled edge portion 122 (FIG. 11) is formed on the end face 120 of the seal element, extending at about a 60° angle relative to the flat 118 and intersecting the outer or peripheral surface of the seal. The shape of the seal element is again designed to engage or nest loosely within correspondingly shaped slots or recesses formed in the bucket shank to provide the required sealing feature.

It will be appreciated that the location and shape of the seal (and the corresponding pin groove and seal receiving recesses) may vary as dictated by specific applications.

It will also be appreciated that the cross-sectional shape of the damper pins need not be cylindrical and the cross-sectional shape of the reduced-diameter ends need not be semi-cylindrical as described above. Other non-round or non-uniformly shaped damper pins are within the scope of the invention. In addition, the damper pin may receive, or be formed with, only one seal element. For pressurized shanks, two seals are preferred while, for non-pressurized shanks, one seal would be sufficient.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A damper pin for a turbine bucket comprising:

an elongated main body portion having a first substantially uniform cross-sectional area and axially-aligned, leading and trailing end portions each having a second relatively smaller cross-sectional area and extending from a respective one of opposite ends of said elongated main body portion, said leading and trailing end portions joining said elongated main body portion at respective shoulders; and a seal element on or adjacent one or both of said opposite leading and trailing end portions projecting outwardly beyond said main body portion around an entire perimeter of the main body portion.

2. The damper pin of claim 1 wherein said seal element is comprised of a nickel or cobalt-based alloy.

3. The damper pin of claim 1 wherein said seal element is adjacent a respective one of said shoulders.

4. The damper pin of claim 1 wherein said seal element is engaged with one of said respective shoulders.

5. The damper pin of claim 1 wherein said seal element is adjacent one or both free ends of said leading and trailing end portions.

6. A damper pin for a turbine bucket comprising:

an elongated main body portion including a substantially uniform cross-sectional shape which is circular and defined by a first diameter, and said main body portion includes axially-aligned, leading and trailing end portions each having a cross-sectional shape different than the cross-sectional shape of the main body portion, said leading and trailing end portions joining said elongated main body portion at respective shoulders of said main body; and a seal element on one or both of said leading and trailing end portions projecting radially outwardly beyond said main body portion.

7. The damper pin of claim 6 wherein each said seal element is substantially circular in shape, with an outer peripheral surface of a diameter greater than said first diameter.

8. The damper pin of claim 6 wherein said axially-aligned, leading and trailing end portions each have a substantially semi-circular cross sectional shape.

9. The damper pin of claim 8 wherein said cross-sectional shape of each said opposite leading and trailing ends has an arcuate extent of between about 180 and 200 degrees.

10. A damper pin for a turbine bucket comprising:

an elongated main body portion having a substantially uniform cross-sectional shape and axially-aligned, leading and trailing end portions each having a cross-sectional shape different than the cross-sectional shape of the main body portion, said leading and trailing end portions joining said elongated main body portion at respective shoulders at opposite ends of the main body portion; and a seal element on one or both of said opposite leading and trailing end portions projecting radially outwardly beyond said main body portion, wherein said seal element has a substantially circular disc shape, with an aperture permitting the seal element to be received over a respective one of said axially-aligned, leading and trailing end portions.

11. A turbine rotor wheel comprising a plurality of circumferentially arranged buckets, each adjacent pair of buckets having a damper pin inserted therebetween, said damper pin comprising:

an elongated main body portion of a first substantially uniform cross-sectional shape, opposite leading and trailing ends of the main body portion, wherein the cross-sectional area of each of the leading and trailing ends is smaller than the cross-sectional area of the main body portion, and a seal element on or adjacent one or both of said opposite leading and trailing end portions projecting outwardly beyond said main body portion around an entire perimeter of the main body portion.

12. The turbine rotor wheel of claim 11 wherein said seal element is on or adjacent a respective one of said shoulders.

13. The turbine rotor wheel of claim 11 wherein each said seal element is engaged with one of said respective shoulders.

14. The turbine rotor wheel of claim 11 wherein said seal element is adjacent one or both free ends of said leading and trailing end portions.

15. The turbine rotor wheel of claim 11 wherein said seal element is seated in a respective, complimentary recess formed in at least one of said adjacent pair of buckets.

16. A turbine rotor wheel comprising:

a plurality of circumferentially arranged buckets, each adjacent pair of buckets having a damper pin inserted therebetween, said damper pin comprising an elongated main body portion of a first substantially uniform cross-sectional shape which is circular and defined by a first diameter, and the damper pin including opposite leading and trailing ends having a cross-sectional shape different than the cross-sectional shape of the damper pin, and a seal element on one or both of said opposite leading and trailing end portions projecting radially outwardly beyond said main body portion, wherein the seal element has an outer peripheral surface having a diameter greater than the first diameter of said first diameter.

17. The turbine rotor wheel of claim 16 wherein said axially-aligned, leading and trailing end portions each have a substantially semi-circular cross sectional shape.

18. The turbine rotor wheel of claim 16 wherein said seal element has a substantially circular disc shape, with an aperture permitting the seal element to be received over a respective one of said axially-aligned, leading and trailing end portions.

19. In a turbine rotor wheel comprising a plurality of circumferentially arranged buckets, each adjacent pair of buckets having a damper pin inserted therebetween, said damper pin comprising an elongated main body portion, leading and trailing ends each extending from a respective one of opposite ends of the main body portion, wherein the main body portion has a first substantially uniform cross-sectional area and the leading and trailing ends each having a cross-sectional area smaller than the cross-sectional area of the main body portion, a method for controlling escape of cooling air from a cavity in a shank portion of the bucket along the damper pin, the method comprising:

providing at least one seal element on the damper pin; and providing at least one recess or slot in the shank portion of the bucket; and locating the damper pin such that said at least one seal element is seated in said at least one recess and said seal element extends beyond the perimeter of the main body portion.

* * * * *

UNITED STATES PATENT AND TRADEMARK OFFICE

CERTIFICATE OF CORRECTION

PATENT NO. : 8,876,478 B2
APPLICATION NO. : 12/948364
DATED : November 4, 2014
INVENTOR(S) : Stephen Paul Wassynger et al.

It is certified that error appears in the above-identified patent and that said Letters Patent is hereby corrected as shown below:

In the Specification

At Column 2, line 22-23, delete “it” and insert --in-- between “will now be described in detail” and “connection with the drawings”.

At Column 3, line 3, insert --20-- between “the damper pin” and “includes a substantially”.

At Column 3, line 13, delete “33” and insert --38-- between “a damper pin” and “in accordance with a first exemplary”.

At Column 3, line 54, insert --a-- between “cooling air from of” and “pressurized cavity in the shank.”.

Signed and Sealed this
Seventeenth Day of February, 2015

Michelle K. Lee

Michelle K. Lee
*Deputy Director of the United States Patent and Trademark Office*